United States Patent [19]

Lisauskas

[11] Patent Number: 4,862,306

[45] Date of Patent: Aug. 29, 1989

[54] COMBINATION MOTOR PROTECTOR AND STARTER APPARATUS

[75] Inventor: Richard J. Lisauskas, Wrentham, Mass.

[73] Assignee: Texas Instruments Incorporated, Dallas, Tex.

[21] Appl. No.: 288,070

[22] Filed: Dec. 22, 1988

[51] Int. Cl.[4] ..... A02H 5/04

[52] U.S. Cl. ..... 361/24; 361/26; 361/27; 361/32; 337/102; 337/107; 310/68 C

[58] Field of Search ..... 361/22, 24, 25, 26, 361/27, 28, 29, 31, 32, 103, 105, 106; 337/102, 103, 104, 105, 106, 107; 310/68 C

[56] References Cited

U.S. PATENT DOCUMENTS

| | | | |
|---|---|---|---|
| Re. 31,367 | 8/1983 | D'Entremont | 361/27 |
| 3,718,879 | 2/1973 | Perry | 337/102 |
| 4,037,316 | 7/1977 | Stoll | 29/622 |
| 4,042,860 | 8/1977 | Woods et al. | 361/25 C |
| 4,131,871 | 12/1978 | Haag et al. | 338/220 |
| 4,237,510 | 12/1980 | Thompson, Jr. et al. | 361/24 |
| 4,241,370 | 12/1980 | De Filippis et al. | 361/24 |
| 4,319,299 | 3/1982 | Woods et al. | 361/24 |
| 4,334,162 | 6/1982 | Haag et al. | 310/68 C |
| 4,387,412 | 6/1983 | Woods et al. | 361/27 |
| 4,422,120 | 12/1983 | Kobayashi et al. | 361/24 |
| 4,492,886 | 1/1985 | Bar | 310/68 C |
| 4,493,144 | 1/1985 | Woods et al. | 29/622 |
| 4,706,152 | 12/1987 | De Filippis et al. | 361/32 |

*Primary Examiner*—A. D. Pellinen
*Assistant Examiner*—H. L. Williams
*Attorney, Agent, or Firm*—John A. Haug; James P. McAndrews; Melvin Sharp

[57] ABSTRACT

A motor protector and starter particularly suited for refrigeration compressor motors are mounted in the recess of a first housing portion with their resilient female sockets disposed in alignment with a pin receiving aperture. Leads are attached to terminals of the motor protector and starter components and directed through lead receiving apertures in the side wall of the first housing portion. A second housing portion is then snapped onto the first housing portion to provide a combination housing which can be installed on a compressor in a one-step on-line operation.

10 Claims, 6 Drawing Sheets

COMBINATION MOTOR PROTECTOR AND STARTER APPARATUS

The present invention relates generally to a combination unit for protecting and starting electric motors and more particularly to such a unit for use with single phase refrigeration compressor motors.

Refrigerator compressors conventionally are provided with a set of connector pins which extend through the shell of the compressor and are connected internally to the main and start windings of the compressor motor. Externally the pins are connected to a motor protector to protect the compressor motor from fault conditions and a motor starter to provide the motor with appropriate inrush current to start the compressor.

Conventionally the protector and the starter are inserted on their respective pins and electrical wires are attached to terminals of the two components, either before or after insertion on the pins. A plastic cover is then placed over the components and clipped in place onto a metal fence circumscribing the pin area to provide required electrical isolation and protection from physical impact.

It is known to combine the motor protector and relay in a single housing either to achieve selected thermal coupling conditions between the protector and starter or just for convenience in handling as well as providing an additional benefit of having the appropriate electrical connections between the protector and the starter already effected prior to attachment to the compressor. However, the other leads still have to be attached to the combination unit either before or after insertion on the pins and the required electrical isolation in the form of the cover clipped over the unit is still required. Further, this unit has the disadvantage in that the housing material required for use with the high temperature positive temperature coefficient (PTC) of resistivity starter element is significantly more expensive per pound than that used for the protector housing or the cover member used to clip over the components.

Whether the components are provided separately or in a combined housing they have required several on-line operational steps, that is steps of assembly while the compressor is moving from one station to another during its manufacture, including, as mentioned above, the attachments of electrical wires and the mounting of the protective cover and cover strap.

BRIEF SUMMARY OF THE INVENTION

It is an object of the present invention to provide a combination motor protector and starter which can be used to reduce the on-line operational steps in assembling refrigeration apparatus.

It is another object of the present invention to provide an improved combination motor protector and starter unit for use with asynchronous refrigerator compressor motors, another object is the provision of such a unit which is universal in character in that it can be used with the compressor of a wide number of sources. Yet another object is the provision of such a unit which will result in lower material costs and reduce refrigerator on-line operations.

Briefly, in accordance with the invention, a two portion combination housing is provided, the first portion having an open top and a recess adapted to receive, off-line, a protector unit and a starter unit with their resilient female sockets aligned with a pin receiving aperture in the bottom wall of first portion. While still off-line electrical wires are attached to the components and directed through lead apertures in the side wall of the first housing portion. A second housing portion is placed over the open top and clipped to the first housing portion to complete the off-line assembly. The combination unit is then brought to the assembly line and in one operational step the unit is placed on the compressor housing by lining up the resilient sockets with the pins and pushing the unit onto the pins.

According to a feature of the invention the combination housing encloses all live electrical connections to meet electrical code requirements thereby eliminating the need for a separate cover member and is configured to fit within the fence area of various compressor manufacturers.

According to another feature, the second housing portion is provided with protrusions aligned with the lead apertures of the first housing portion and is adapted to engage the electric wires directed therethrough to provide strain relief to the internal electrical connections.

According to another feature of the invention a wall projects into the recess from the bottom wall of the first portion to limit movement of the starter and to limit access into the recess by a short circuiting foreign element.

According to yet another feature of the invention the protector is mounted for slight movement and has a tapered entrance to its resilient socket so that it is self aligning as its respective compressor pin is inserted therein.

DESCRIPTIONS OF THE DRAWINGS

Other objects, advantages and specific features of the novel and improved combination motor protector and starter of this invention especially adapted for use with refrigeration motor compressor systems appear in the following detail description of the preferred embodiment of the invention, the detailed description referring to the drawings in which.

DESCRIPTION OF THE PREFERRED EMBODIMENT

Figure 1:
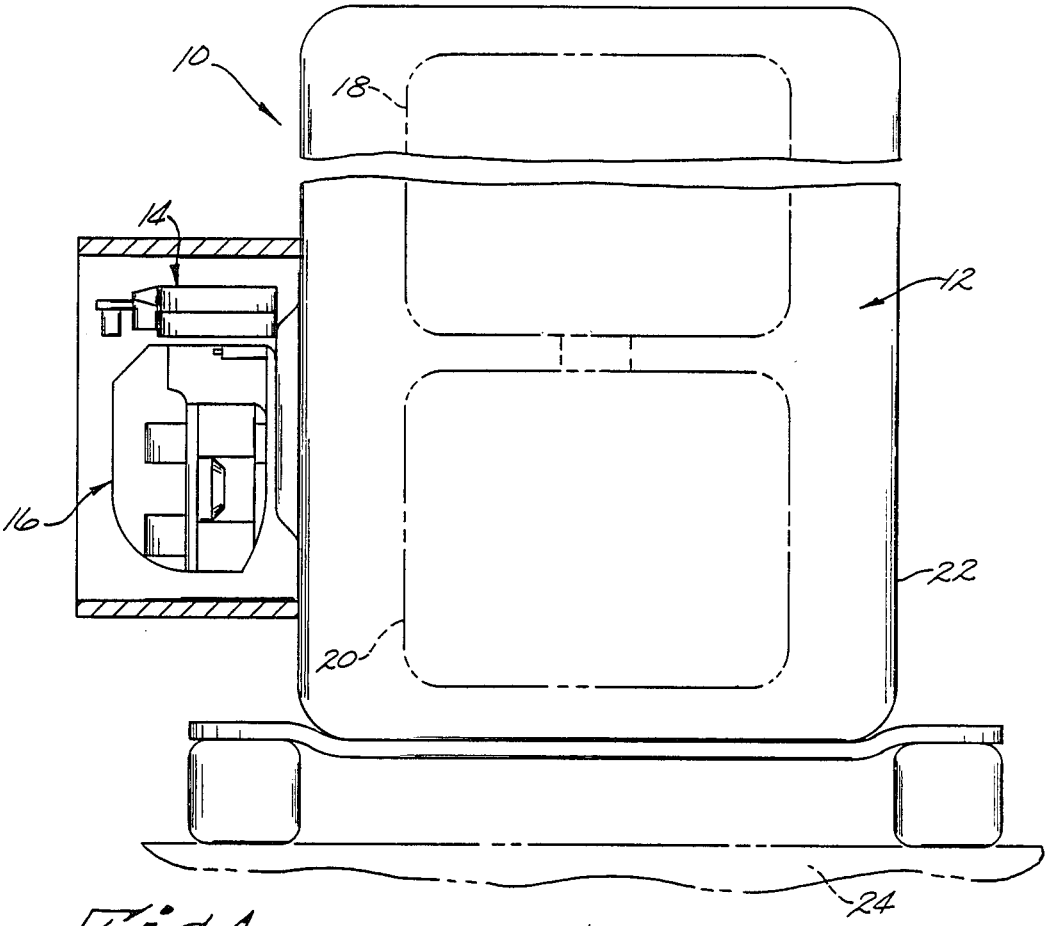
FIG. 1 is a diagrammatic side elevation view of a refrigerator compressor motor system on which a motor protector and a motor starter are conventionally mounted on respective connector pins.
Figure 2:
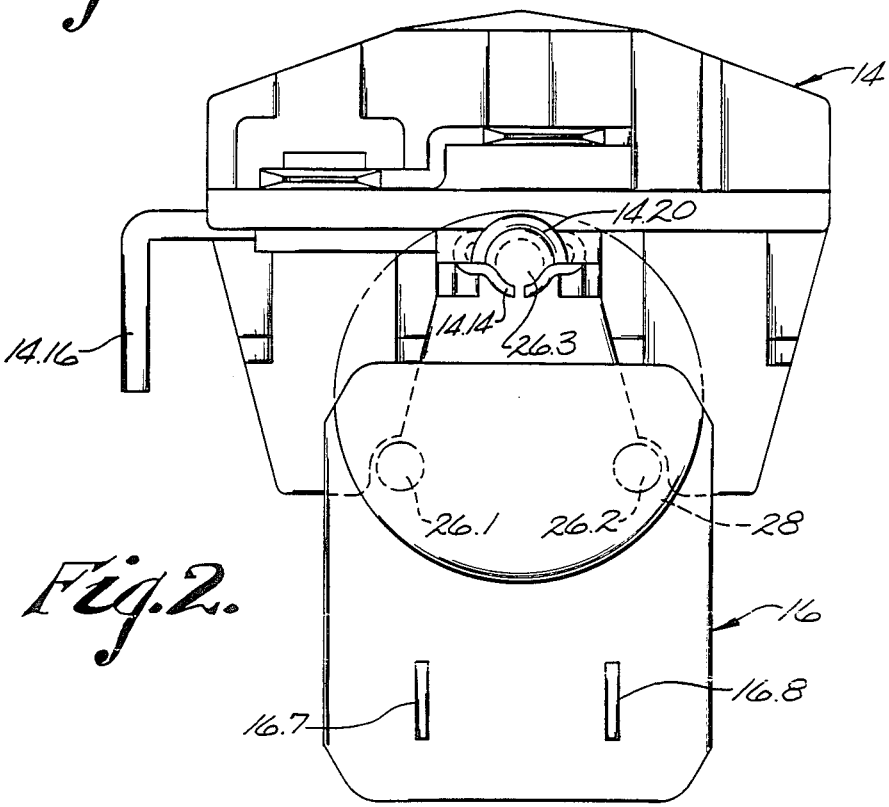
FIG. 2 is a partial side elevation view of the system of FIG. 1.

Referring to the drawings, FIG. 1 shows a refrigerator compressor motor system 10 including a conventional sealed compressor unit 12, a conventional motor protector means 14 such as that shown and described in U.S. Pat. No. 4,706,152 incorporated herein by this reference and a conventional PTC motor starting means 16 such as that shown and described in U.S. Pat. No. 4,241,370 incorporated herein by this reference. The sealed compressor unit incorporates a conventional electrical motor 18 and a refrigerator compressor 20 operated by the motor which are hermetically sealed in a common metal shell 22. The unit is mounted in any conventional manner in any refrigerator appliance, for example, as is diagrammatically illustrated at 24. Thermally and electrically conductive lead through pins 26.1, 26.2 and 26.3 (FIG. 2), electrically insulated from the shell and from each other by glass seal means 28 or the like, extend in sealed relation through the shell to make electrical connection to the windings of the electrical motor in the shell.

Figure 3:
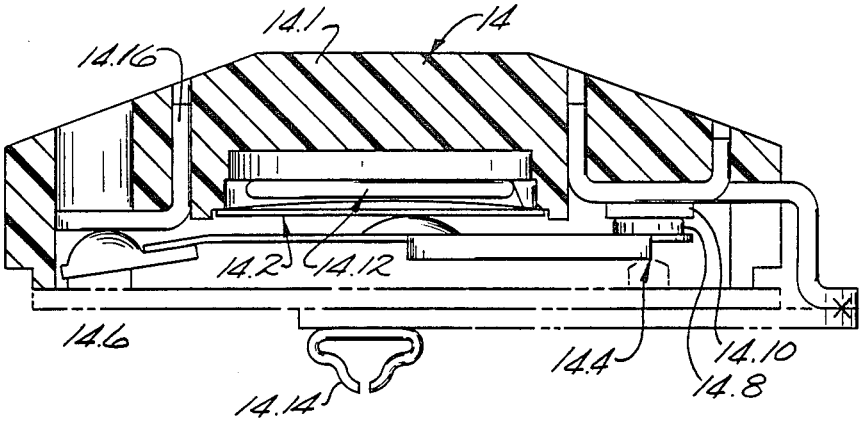
FIG. 3 is a section view of the protector portion of FIGS. 1 and 2.

Motor protector means 14 includes, as seen in FIG. 3, a housing 14.1 mounting a snap acting disc 14.2 formed of thermostat metal and is movable between opposite dished configurations in response to temperature. A movable contact arm 14.4 cantilever mounted at 14.6 has a movable electric contact 14.8 mounted on a free end thereof adapted to move into and out of electrical engagement with stationary contact 14.10 in response to the dished configuration of disc 14.2. An electrical resistance heater means 14.12 is electrically coupled to the motor circuit current to heat the thermostat disc. When the disc snaps to the configuration opposite to that shown in FIG. 3 it will bias the free end of arm 14.4 away from stationary contact 14.10 to interrupt the circuit. Resilient female socket means 14.14 is adapted to be received on pin 26.3 while terminal means 14.16 is adapted for connection to a separate electrical lead as will be explained below.

Figure 4:
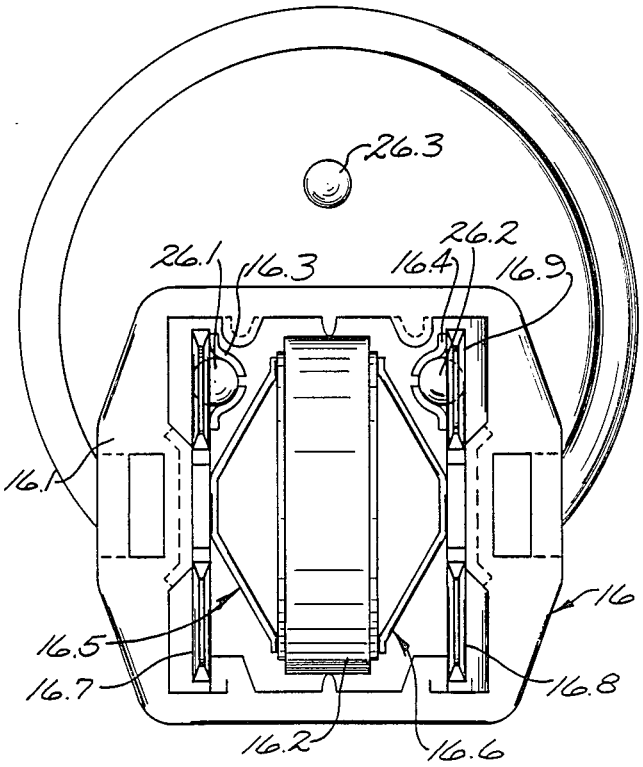
FIG. 4 is a side view of the starter shown in FIGS. 1 and 2 with the lid removed.

Motor starter means 16 includes, as seen in FIG. 4, a housing 16.1 in which is disposed a positive temperature coefficient (PTC) of resistivity element 16.2. Contact means comprise resilient female socket means 16.3 and 16.4 attached to metal spring contacts 16.5 and 16.6 respectively engaging opposite sides of PTC element 16.2 and disposed between housing 16.1 and respective opposite sides of PTC element 16.2. Socket means 16.3 and 16.4 form lower terminals adapted to be placed in engagement with pins 26.1 and 26.2 respectively and are formed with upper terminals 16.7 and 16.8 respectively extending from the opposite side of housing 16.1 adapted to be connected to electric leads. Terminal 16.9 may commonly be used for the power connection in resistor start capacitor run (RSCR) applications.

Conventionally, components 14 and 16 are placed on pins 26.1, 26.2 and 26.3 as the compressor unit moves along an assembly line. Appropriate leads are then attached to terminals 14.16, 16.7, 16.8 and 16.9 and then a plastic cover is placed over both components and clipped to shell 22 to electrically isolate all electrical connections and provide protection from impact.

Figure 5:
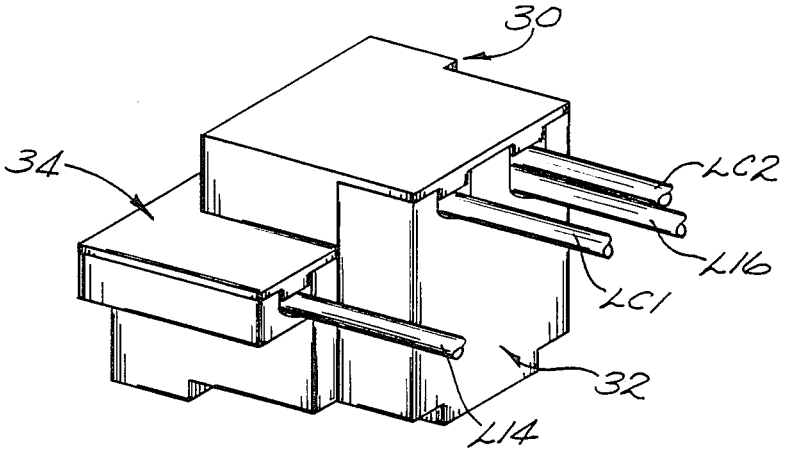
FIG. 5 is a perspective view of a combination motor protector and starter unit made in accordance with the invention.

In accordance with the present invention a combination housing 30 as seen in FIG. 5 provides for one step on-line installation of the motor protector, motor starter components. Housing 30 comprises a first housing portion 32 which cooperates with a second housing portion 34 to provide a combination housing which permits off-line assembly of the motor protector and motor starter components and connection of appropriate electrical wires so that the combination can be installed on a compressor unit merely by pushing it onto the connector pins extending through the compressor unit shell.

Figure 6:
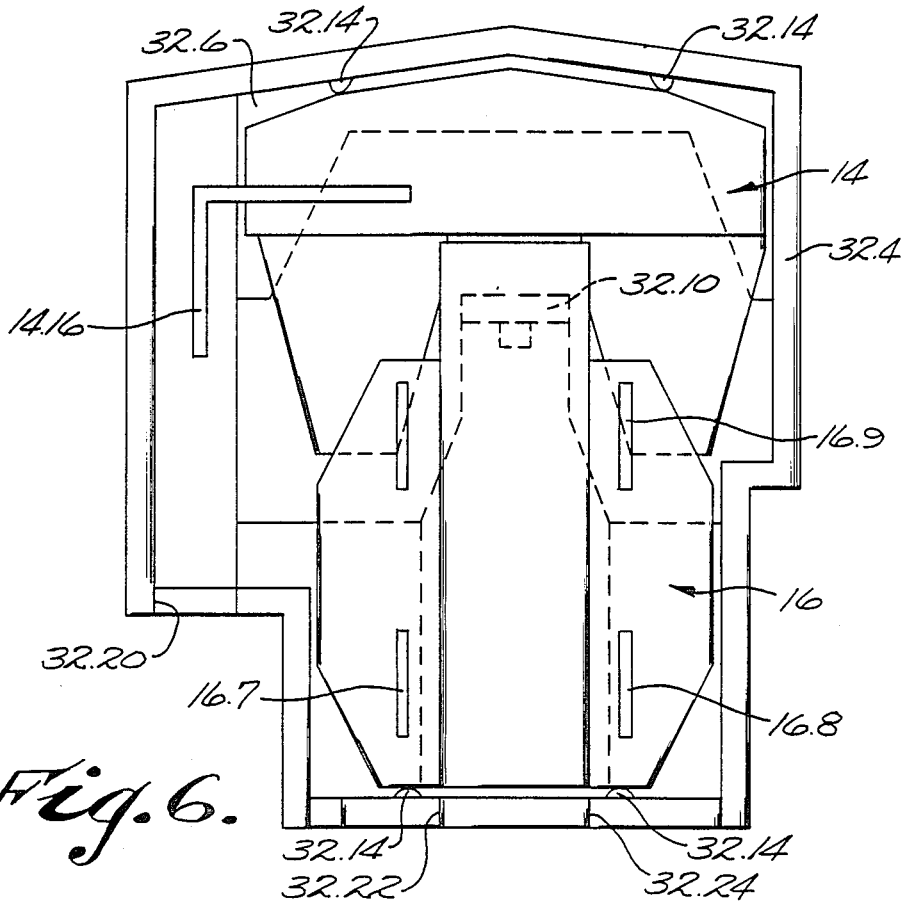
FIG. 6 is a side view of the FIG. 5 combination unit as it would be mounted on the connector pins shown with the lid and electrical leads removed.
Figure 7:
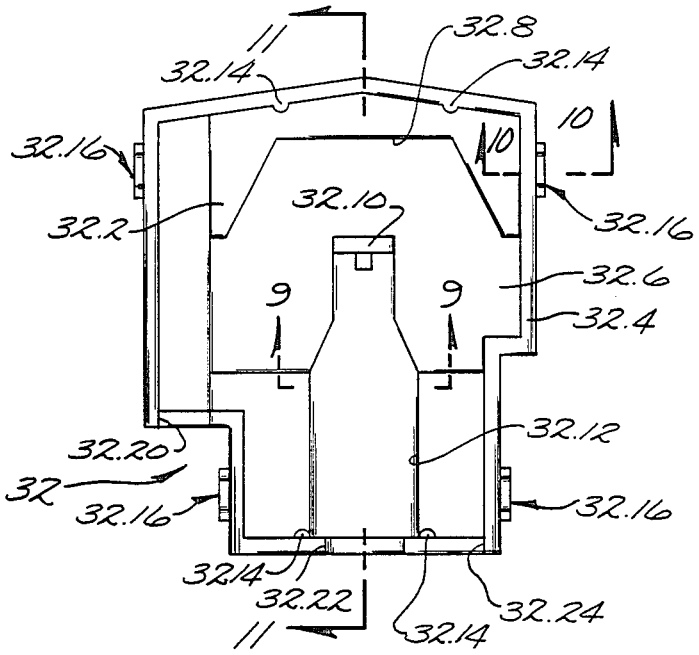
FIG. 7 is a top plan view (this would be a side view to be consistent with FIGS. 1–6) of the first portion of the combination unit housing.
Figure 8:
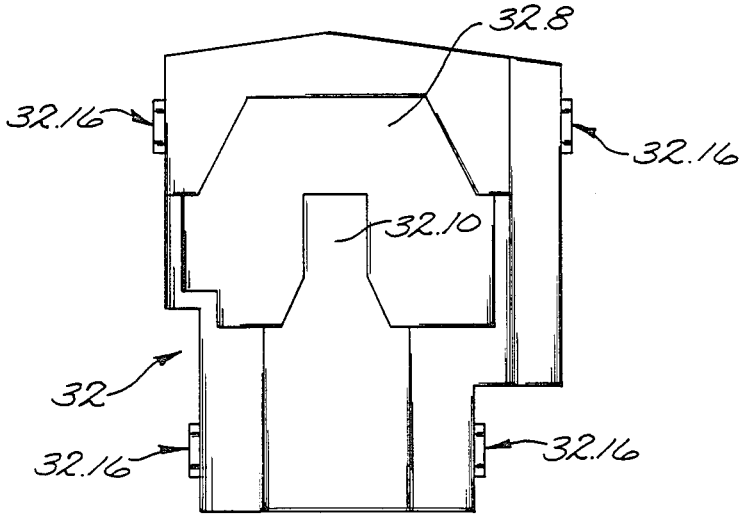
FIG. 8 is a bottom view of FIG. 7 housing portion.
Figure 9:
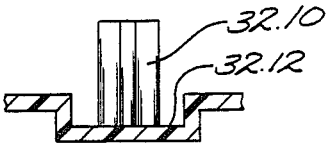
FIG. 9 is a cross sectional view through line 9—9 of FIG. 7.
Figure 10:
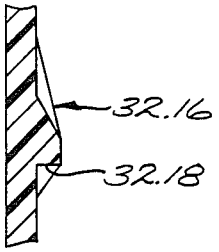
FIG. 10 is a cross sectional view through line 10—10 of FIG. 7.
Figure 11:
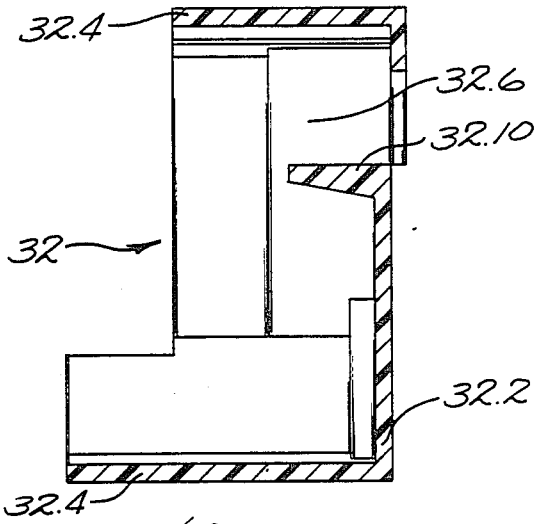
FIG. 11 is a cross sectional view through line 11—11 of FIG. 7.
Figure 12:
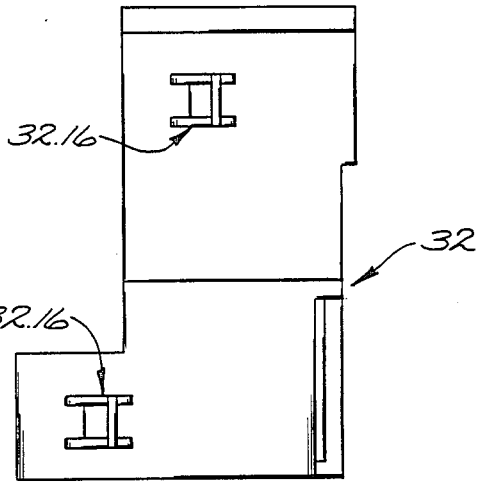
FIG. 12 is a side view of the FIG. 7 housing portion.
Figure 13:
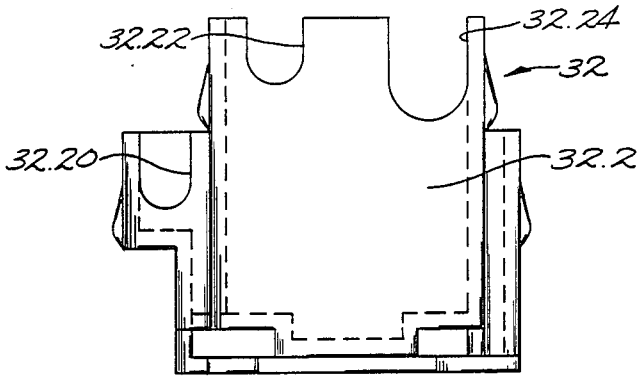
FIG. 13 is a front view of the FIG. 7 housing portion.
Figure 14:
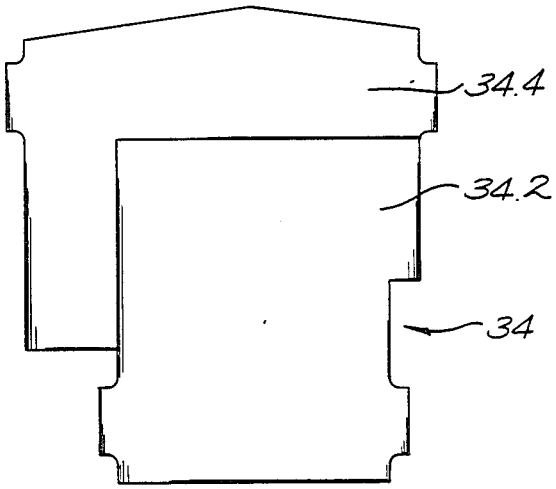
FIG. 14 is a top plan view of the second portion of the combination unit housing.
Figure 15:
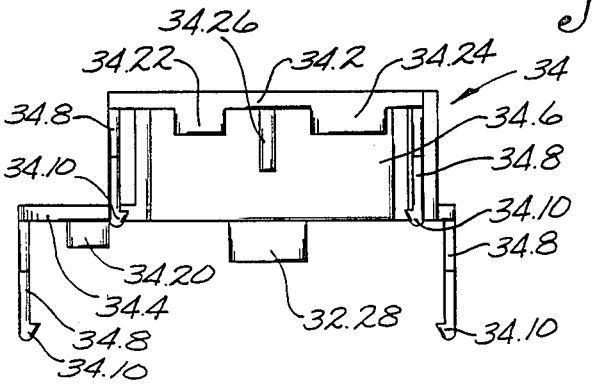
FIG. 15 is a front view of the FIG. 14 housing portion.
Figure 16:
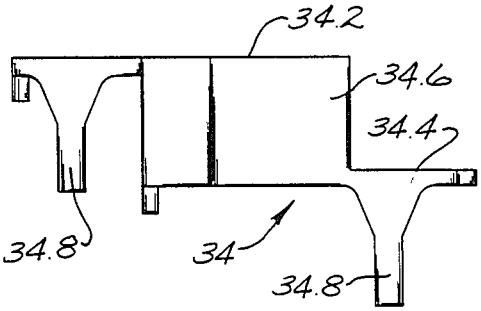
FIG. 16 is a side view of the FIG. 14 housing portion.

With reference to FIGS. 7–13 housing portion 32 comprises a bottom wall 32.2 with depending side wall 32.4 forming a recess 32.6 therein. A pin receiving aperture 32.8 generally in the shape of an inverted U is formed in the bottom wall to accommodate triangularly disposed pins 26.1, 26.2, 26.3 discussed supra. A leg 32.10 projects from the bottom wall 32.2 into recess 32.6 to separate the portions of the recess designated for the protector component from the starter component, to limit movement of the starter component and, most importantly, to prevent access to internal electrical connections by a foreign member such as a probe. A groove 32.12 is formed in the bottom wall to receive a complimentary shaped portion of the starter housing 16.1 and locating protrusions 32.14 are formed in opposite ends of side wall 32.4 to facilitate location of starter component 16 and protector component 14 as shown in FIG. 6. A plurality of snap attachment means 32.16 are formed on the outer surface of side wall 32.4, each providing a ledge portion 32.18 (see FIG. 10) adapted to lockingly receive a respective tongue portion of second housing portion 34 to be described below. It will be understood that other means of attachment, such as staking, could be employed if desired. As best seen in FIG. 13 lead receiving apertures in the form of slots 32.20, 32.22 and 32.24 are provided in side wall 32.2 at an end of housing portion 32.

Second housing portion 34 comprises a top walls 34.2, 34.4, depending side wall 34.6 and legs 34.8. Tongues 34.10 attached to the distal end of legs 34.8 are adapted to slide over respective ledges 32.18 of the attachment means to effectively lock housing portion 32 and 34 together upon assembly.

Downwardly depending protrusions 34.20, 34.22 and 34.24 extend from top wall 34.2 and are aligned with lead apertures 32.20, 32.22 and 32.24 respectively as will be discussed further below. Downwardly depending wall portions 32.26 extends from top wall 34.2 and is aligned with the starter component seat so that upon assembly a force exerted on the combination housing 30 can be transferred through to the pins when installing housing 30 on a compressor unit. In like manner, wall 32.28 aligns with protector unit 14 for support.

In accordance with the invention, as seen in FIGS. 5 and 6, protector unit 14 is inserted in recess 32.6 and is relatively loosely held within the recess between upper protrusions 32.14 and leg 32.10. Starter unit 14 is inserted with very little play or movement, as seen in FIG. 6, in a direction toward protector unit 14. Insulated electric wires or leads are attached to protector terminal 14.16 and starter terminals 16.7, 16.8 and 16.9. Lead L14 attached to terminal 14.16 is directed through lead aperture 32.20, capacitor leads LC1 and LC2 are attached to terminal 16.7 and 16.8 and directed through apertures 32.22 and 32.24 respectively and lead L16 is attached to a second terminal 16.9 and directed through aperture 32.24. Second housing unit 34, which serves as a cover, is then placed over the recess and tongues 34.10 snapped over ledges 32.18 which results in protrusions 34.20, 34.22 and 34.24 engaging leads passing through the lead apertures thereby placing a force on the leads and providing strain relief to the internal electrical connections.

Unit 30 is then supplied to the assembly line and is installed on a compressor unit in a single on-line operation by pushing the unit onto the connector pins extending through the compressor unit shell. The housing of protector 14 is provided with a tapered portion 14.20 adjacent to socket 14.4 (see FIG. 2) which serves as a self aligning mechanism when unit 30 is placed onto the pins; pin 26.3 will engage the tapered portion and automatically adjust the position of protector 14 in its seat as determined by the position of pins 26.1, 26.2. The combination housing, by enclosing all live electrical connections, meets all electrical code requirements thereby obviating a need for a separate cover required by the prior art. The combination housing is configured to be universal with regard to fitting within the fence area of the compressors of various manufacturers.

The present invention has been described by way of a preferred form of realization. It will be understood, however, that variations and modifications can be made in the same without departing from the scope of the present invention.

What is claimed:

1. A combination motor protector and starter for protecting and starting single phase asynchronous motors comprising a combination housing formed of electrically insulative material having a first portion with a recessed portion formed by a bottom wall and side walls, a motor starter comprising a starter housing, a resistor of a material of positive temperature coefficient of resistivity within the starter housing, electrically conducting starter contact means mounted in the starter housing for connecting the resistor in an electrical circuit, the starter contact means having upper and lower starter terminal means thereon extending from opposite sides of the starter housing, the lower starter terminal means comprising first and second resilient starter socket means for facilitating mounting of the starter on connector pins of a refrigerator compressor motor, the starter housing received in the recessed portion with the resilient starter socket means aligned with a pin receiving aperture in the bottom wall of the combination housing, electrical leads secured to the upper terminal means, a motor protector comprising a protector housing, protector contact means mounted in the protector housing including a circuit element mounted for relative movement between positions opening and closing the motor circuit, thermostat metal means adapted to move from an original dished configuration to an inverted dished configuration with snap action when heated to a selected actuation temperature and return to its original dished configuration with snap action when subsequently cooled to a relatively lower reset temperature, the thermostat metal means being mounted in the protector housing to move the circuit element between said circuit positions in response to movement of the thermostat metal means between the dished configurations, electrical resistance heater means responsive to motor circuit current to heat the thermostat metal means, first protector terminal means comprising a resilient protector socket means coupled to the protector contact means for mounting of the protector on a connector pin of the refrigerator compressor motor and second protector terminal means coupled to the protector contact means for connection to a power source, the motor protector received in the recessed portion with the resilient protector socket means aligned with the pin receiving aperture in the bottom wall of the combination housing, an electrical lead secured to the second protector terminal means, the side walls of the first portion of the combination housing formed with lead apertures through which the electrical leads attached to the starter and the protector extend, a second portion of the combination housing having wall means, the second portion of the combination housing meeting with the first portion to enclose the starter and the protector and electrically isolate the starter and the protector from the outer environment except for the leads extending through the side walls of the first portion and the resilient starter and protector socket means whereby the combination motor protector and starter can be installed on a refrigerator compressor on an assembly line in a single step by aligning the resilient starter and protector socket means with the connector pins of the refrigerator compressor and pushing the combination housing onto the connector pins.

2. A combination motor protector and starter for protecting and starting single phase asynchronous motors according to claim 1 further including protrusions formed in the second portion and aligned with the electrical lead apertures of the first portion and being adapted to engage the electric leads when the second portion is attached to the first portion to provide strain relief to electrical connections within the combination housing.

3. A combination motor protector and starter for protecting and starting single phase asynchronous motors according to claim 1 in which the motor protector is slightly movable in the recessed portion relative to the starter and the protector housing has a beveled section adjacent to the resilient protector socket to provide self aligning of the protector as a respective connector pin is inserted in the said resilient protector socket.

4. A combination motor protector and starter for protecting and starting single phase asynchronous motors according to claim 1 in which the bottom wall of the first portion of the combination housing has an upstanding leg extending into the recessed portion, the leg being adapted to restrict movement of the starter in a direction toward the protector.

5. A combination motor protector and starter for protecting and starting single phase asynchronous motors according to claim 1 in which the second portion of the combination housing has a depending wall portion so located that it is adapted to engage the starter housing to transfer force to the resilient sockets when mounting the combination housing onto connector pins.

6. A combination motor protector and starter for protecting and starting single phase asynchronous motors comprising a combination housing formed of electrically insulative material having a first portion with a recessed portion formed by a bottom wall and side walls, a motor starter comprising a starter housing, a resistor of a material of positive temperature coefficient of resistivity within the starter housing, electrically conducting starter contact means mounted in the starter housing for connecting the resistor in an electrical circuit, the starter contact means having upper and lower starter terminal means thereon extending from spaced portions of the starter housing, the lower starter terminal means comprising first and second resilient starter socket means for facilitating mounting of the starter on connector pins of a refrigerator compressor motor, the starter housing received in the recessed portion with the resilient starter socket means aligned with a pin receiving aperture in the bottom wall of the combination housing, electrical leads secured to the upper terminal means, a motor protector comprising a protector housing, first protector terminal means comprising a resilient protector socket means coupled to the protector for mounting of the protector on a connector pin of the refrigerator compressor motor and second protector terminal means coupled to the protector for connection to a power source, the motor protector received in the recessed portion with the resilient protector socket means aligned with the pin receiving aperture in the bottom wall of the combination housing, an electrical lead secured to the second protector terminal means, one of the side walls of the first portion of the combination housing and wall means of a second portion of the combination housing formed with lead apertures through which the electric leads attached to the starter and the protector extend, a second portion of the combination housing having wall means, the second portion of the combination housing meeting with the first portion to enclose the starter and the protector and electrically isolate the starter and the protector from the outer environment except for the leads extending through walls of the combination housing and the resilient starter and protector socket means whereby the combination motor protector and starter can be installed on a refrigerator compressor on an assembly line in a single step by aligning the resilient starter and protector socket means with the connector pins of the refrigerator compressor and pushing the combination housing onto the connector pins.

7. A combination motor protector and starter for protecting and starting single phase asynchronous motors according to claim 6 in which the second portion of the combination housing has a depending wall portion so located that it is adapted to engage the starter housing to transfer force to the resilient sockets when mounting the combination housing onto connector pins.

8. A combination motor protector and starter for protecting and starting single phase asynchronous motors according to claim 6 further including protrusions formed in the other of the first portion and the second portion and aligned with the electrical lead apertures and adapted to engage the electric leads when the second portion is attached to the first portion to provide strain relief to electrical connections within the combination housing.

9. A combination motor protector and starter for protecting and starting single phase asynchronous motors according to claim 6 in which the motor protector is slightly movable in the recessed portion relative to the starter and the protector housing has a beveled section adjacent to the resilient protector socket to provide self aligning of the protector as a respective connector pin is inserted in the said resilient protector socket.

10. A combination motor protector and starter for protecting and starting single phase asynchronous motors according to claim 6 in which the bottom wall of the first portion of the combination housing has an upstanding leg extending into the recessed portion adapted to restrict movement of the starter in a direction toward the protector.

* * * * *